US007364643B2

(12) United States Patent
Poikolainen et al.

(10) Patent No.: US 7,364,643 B2
(45) Date of Patent: Apr. 29, 2008

(54) FORMING OF A PAPER OR BOARD WEB IN A TWIN-WIRE FORMER OR IN A TWIN-WIRE SECTION OF A FORMER

(75) Inventors: Antti Poikolainen, Jyväskylä (FI); Jeffrey C. Irwin, Clinton, WI (US); Michael Odell, Jyväskylä (FI); Hannu Korhonen, Jyväskylä (FI); Ari Puurtinen, Jyväskylä (FI); Sami Anttilainen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 284 days.

(21) Appl. No.: 10/525,275

(22) PCT Filed: Jun. 16, 2003

(86) PCT No.: PCT/FI03/00481

§ 371 (c)(1),
(2), (4) Date: May 24, 2005

(87) PCT Pub. No.: WO2004/018768

PCT Pub. Date: Mar. 4, 2004

(65) Prior Publication Data

US 2006/0162890 A1 Jul. 27, 2006

Related U.S. Application Data

(60) Provisional application No. 60/405,373, filed on Aug. 23, 2002, provisional application No. 60/405,372, filed on Aug. 23, 2002.

(51) Int. Cl.
*D21F 1/00* (2006.01)
*D21F 11/00* (2006.01)
*D21F 9/00* (2006.01)

(52) U.S. Cl. ..... 162/203; 162/211; 162/300; 162/301; 162/351; 162/352

(58) Field of Classification Search ..... 162/198, 162/199, 203, 272–274, 300, 301, 303, 352, 162/364, 208, 209, 210, 211, 217, 351
See application file for complete search history.

(56) References Cited

U.S. PATENT DOCUMENTS

| | | | | |
|---|---|---|---|---|
| 5,225,043 | A * | 7/1993 | Braun et al. | 162/301 |
| 5,389,206 | A * | 2/1995 | Buck et al. | 162/301 |
| 5,507,918 | A * | 4/1996 | Polifke et al. | 162/301 |
| 5,798,024 | A * | 8/1998 | Odell et al. | 162/203 |
| 5,871,617 | A * | 2/1999 | Iwata et al. | 162/301 |
| 5,914,009 | A * | 6/1999 | Kotitschke | 162/301 |
| 5,972,168 | A | 10/1999 | Egelhof et al. | |
| 6,372,091 | B2 * | 4/2002 | Wildfong et al. | 162/301 |
| 6,669,820 | B2 * | 12/2003 | Odell | 162/300 |

FOREIGN PATENT DOCUMENTS

| | | |
|---|---|---|
| EP | 0 688 900 A1 | 12/1995 |
| GB | 1 228 277 | 9/1972 |
| WO | WO 2004/018768 A1 | 3/2004 |

OTHER PUBLICATIONS

International Preliminary Examination Report Issued in PCT/FI03/00481, Nov. 17, 2004.
Search Report issued in PCT/FI03/00481, Oct. 17, 2003.

* cited by examiner

*Primary Examiner*—Eric Hug
(74) *Attorney, Agent, or Firm*—Stiennon & Stiennon

(57) ABSTRACT

Fibrous stock is supplied by a paper or board machine headbox (1) between looped forming wires (11, 12). Water is removed in a first dewatering zone (Z1) formed with a fixed forming shoe (3) having a curved surface against which a wire (12) is supported while the opposite wire (11) is unsupported in the area of the shoe (3). Water is removed in a second dewatering zone (Z2) formed by fixed dewatering blades (21) on the other side of the wires (11, 12) and supported against the stock therebetween (21) and on the opposite side of the wires (11, 12) by dewatering blades (24), loaded in a controlled manner against the fixed dewatering blades (21) at gaps (22) between these so that pulsating dewatering is caused in the second zone (Z2). The wires (11, 12) are guided so the shoe (3) causes essentially non-pulsating dewatering in the stock.

10 Claims, 8 Drawing Sheets

FORMING OF A PAPER OR BOARD WEB IN A TWIN-WIRE FORMER OR IN A TWIN-WIRE SECTION OF A FORMER

CROSS REFERENCES TO RELATED APPLICATIONS

This application is a U.S. national stage application of International App. No. PCT/FI2003/000481, filed Jun. 16, 2003, and claims the benefit of priority of U.S. provisional applications Nos. 60/405,372 and 60/405,373, filed Aug. 23, 2002, the disclosures of all of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention concerns forming of a paper or board web from aqueous wood fibre stock. More specifically, the invention concerns a method and device for forming paper or board at a high speed in the early stage of web formation.

When making paper of aqueous wood fibre stock, the initial formation was then done on one forming wire, such as a Fourdrinier wire part, or in a twin-wire former, such as the so-called gap former, wherein a pair of opposite wire loops traveling in the same direction forms a closing gap, into which a stock jet is supplied from a headbox into the space between the forming wires, water is removed from the stock through the forming wires in order to start formation of the paper web by leaving the woodpulp fibres randomly distributed on the forming wire or in between the forming wires traveling together.

Depending on the quality of the paper or board to be made, fibre pulps of different types are used. The quantity, with which water can be removed from different fibre pulps in order to bring about a paper product of good quality, is a function of many factors, such as, for example, a function of the desired standard of the paper product, of the desired caliper of the paper product to be made, of the design velocity of the paper machine, and of the desired standard of fines, fibres and fillers in the final paper product.

It is known in the state of the art to use forming shoes to guide one or two forming wires on the forming section of the paper machine. It is also known to use a so-called forming roll equipped with an open, for example, perforated surface to receive water through the forming wire into the interior of the forming roll from the fibre pulp supported by the outer surface of the forming wire.

It is further known to use a forming shoe, whose surface has grooves starting in the downfeed direction from the leading edge of the forming shoe and extending at a small angle in relation to the machine direction (that is, in relation to the traveling direction of the paper web through the paper machine).

Devices of several types are known in the paper machine's forming section, that is, in the former, such as foil blades, suction boxes, hitch rolls, suction rolls and rolls provided with an open surface, which have been used in several different formations and sequences when trying to optimize the quantity of exiting water, the time and the location during the paper web formation. The making of paper is still an art in part in that simply removing water as quickly as possible will not produce a paper product of optimum quality. In other words, the production of a high-quality paper product at high velocities, for example, at approximately 2000 m/min, is a function of the quantity of removed water, of the manner in which water is removed, of the duration of dewatering and of the location where water is removed from the stock or in between the forming wires.

Earlier when paper machines operated at lower velocities, for example at 900-1200 m/min, relative utilization of the above-mentioned factors could vary in order to achieve the desired quality in the paper product. In addition, when desiring to maintain or improve the product quality when making a product at higher speeds, unforeseen problems will occur in most processes, so that either the production quantity must be reduced to maintain or achieve the desired quality or the desired quality must be sacrificed in order to achieve a higher production quantity.

The blade elements or foils of earlier forming shoes or blade shoes had a forming shoe surface of a curved or planar shape, they had several gaps in between the blade elements, which extended in the longitudinal direction over the blade element length. The gaps for their part define leading edges for the blade elements, which blade elements are arranged in the cross-machine direction at right angles to the traveling direction of the forming wire. Such an arrangement works well. The stock jet is directed against the forming wire over the leading edge of the forming shoe/blade in such a way that a part of the water in the stock jet will travel through the forming wire and end up below the shoe/blade. Each foil, blade element or forming shoe is either open to atmospheric pressure at its bottom or they are connected to an under-pressure source in order to improve dewatering by forcing water into gaps in between adjacent foils or blade elements. The blade elements form the top surface or deck of the foil or forming shoe.

However, with increasing paper machine velocities to make paper products with ever improved economy, new phenomena begin occurring in connection with the paper machine's runnability and also relating to the appearance and internal structure of the produced paper product. Most of these changes are not desirable.

These phenomena may occur in different forms, such as an undesirable distribution of fines and fillers in the paper product's surface or internal parts, whereby the acceptable retention or finer retention would decrease. These changes and imperfections are disastrous for the paper product and affect its saleability.

There are two techniques in principle, which are in general use in the formation of printing stock and writing paper, that is, blade type gap formers and roll gap formers. Both these techniques have certain advantages and disadvantages, of which the following may be listed.

Advantages of the roll gap former are that the impingement of the headbox jet onto a roll having a relatively large radius is very insensitive to minor geometrical errors in the jet quality and to external effects, such as windage and water drops, that Z direction properties, such as regards fillers and anisotropy, can be achieved and excellent two-sidedness due to the fact that a fibre mat is formed at first at the same time on both wires at a constant (that is, non-pulsating) dewatering pressure, and that a good retention can be achieved due to the fact that initially a constant (that is, non-pulsating) dewatering pressure exists in the dewatering zone. A considerable disadvantage of this technique is that rotation of the forming roll results in a vacuum pulse on the exit side of the roll nip. This pulse will partly damage (crush) the formed paper structure as it travels from the zone with a constant pressure into the following zone with a pulsating pressure, if the paper is too wet at this point. In practice, this limits the formation quality of this type of former, because the quantity of water, which can be made to transfer into the pulsating dewatering zone, is limited by this vacuum pulse. Essential disadvantages are also the costs of the forming roll and its spare parts as well as the roll's need of maintenance and the resulting time of machine shutdown. Another noticed problem with the roll gap former is the insufficient dewatering capacity at high speeds (>1600 m/min) and with dense pulps.

Advantages of the blade type gap former are that because to begin with the jet dewatering is carried out at a pulsating pressure, the formation potential of this type of former is very good. Since all dewatering components are fixed, acquisition and maintenance costs are lower than when using a roll as the first dewatering device.

This technique has the following disadvantages, among others. The jet inpingement onto a shoe having a relatively large radius and constructed to create pulsating dewatering is very sensitive to numerous errors. This is the main limitation of an efficient operation of formers of this type. The initial dewatering is quite asymmetric, which results in a very one-sided paper structure in the Z direction, especially as regards fillers and anisotropy. Because dewatering of the pulp is initially done with a pulsating pressure, the retention is low.

As regards the state of the art, reference is also made to U.S. Pat. No. 5,798,024; US patent application publication No. 2001/0025697, now U.S. Pat. No. 6,372,091; and GB patent No. 1,288,277.

SUMMARY OF THE INVENTION

With the aid of the present invention the above-mentioned drawbacks and disadvantages have been eliminated or reduced, which are caused by the forming shoe or blade element on the paper machine's forming section to the production and quality of the paper product. A method is provided in the twin-wire forming section of a paper or board machine, wherein fibrous stock supplied by a headbox is guided in between forming wires formed as wire loops, where water is removed from the fibrous stock in at least two successive dewatering zones. At least a part of the first dewatering zone is formed with the aid of a fixed forming shoe having a curved surface and against which one of the forming wires is supported while the opposite forming wire is unsupported in the area of the forming shoe. The other dewatering zone is formed by fixed dewatering blades on the other side of the forming wires and supported against the fibrous stock located in between them and on the opposite side of the forming wires by dewatering blades, which can be loaded in a controlled manner against the fixed dewatering blades at gaps between these in such a way that pulsating dewatering is caused in the fibrous stock in the second dewatering zone. The forming wires are guided from the beginning of the twinwire forming section into the area of the fixed forming shoe of the first dewatering zone in such a way that the fixed forming shoe is used to cause essentially non-pulsating dewatering in the fibrous stock traveling in between the forming wires, which dewatering is applied to the fibrous stock in the area after the leading edge of the fixed forming shoe. The invention also concerns a twinwire forming section.

Other objects, characteristic features and advantages of the invention will emerge from the following detailed description and from the figures in the appended drawing.

DESCRIPTION OF THE PREFERRED EMBODIMENTS

Figure 1:
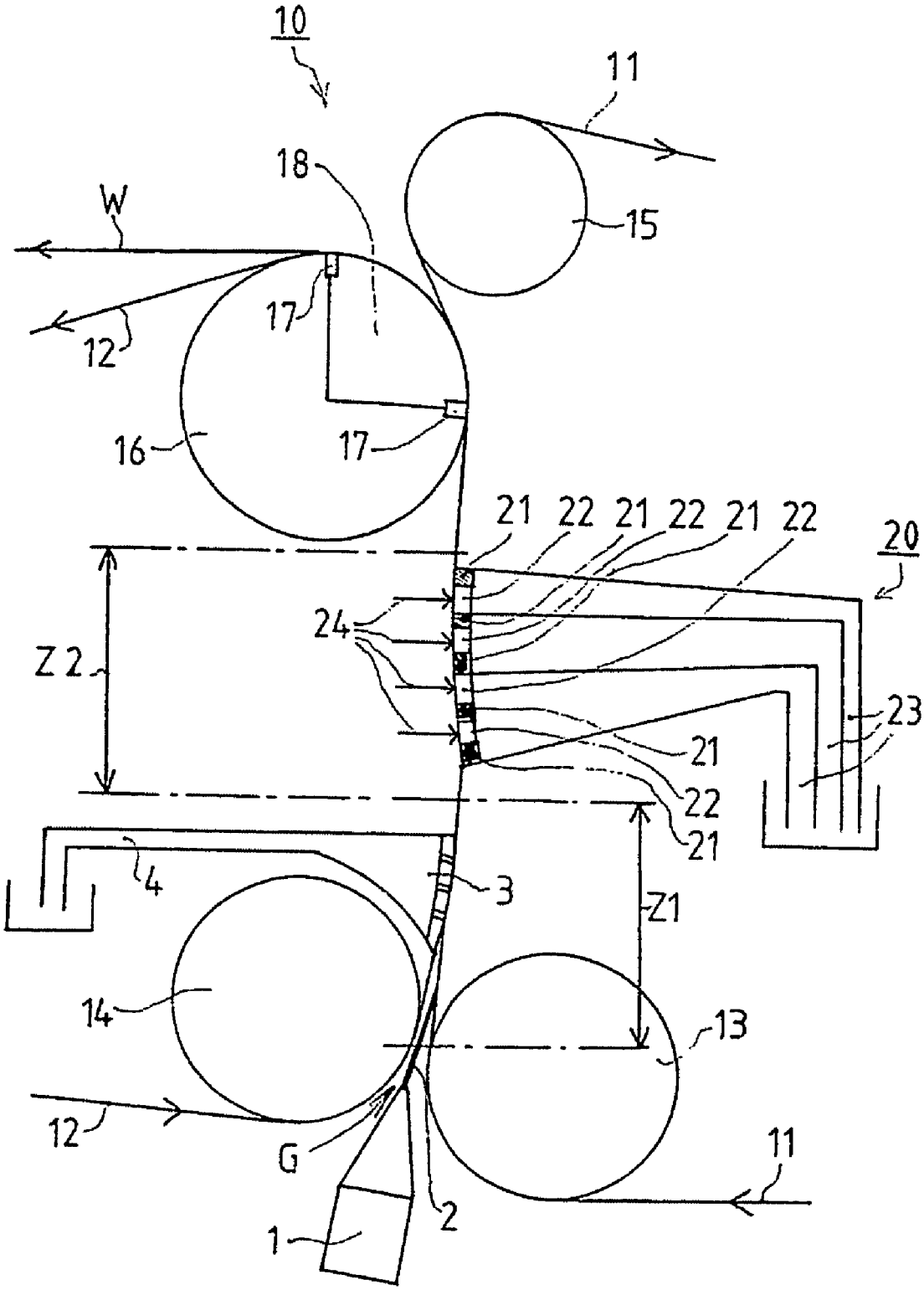
FIG. 1 is a schematic lateral view of an advantageous embodiment of the former according to the invention.

Referring in greater detail to the figures in the drawing and first to FIG. 1, it shows an advantageous embodiment of the former according to the invention. The former shown in FIG. 1 is a blade type gap former and it is marked generally by reference number 10. Former 10 includes two forming wires 11, 12, which are formed into endless wire loops (not shown) with the aid of hitch rolls and guiding rolls. Of the rolls FIG. 1 shows the first breast roll 13 of the first forming wire 11 on the wire loop side, through which breast roll the first forming wire 11 is guided into the dewatering area, and a guiding roll 15, which guides the first forming wire 11 after the formation area into a first wire loop. Correspondingly, the second breast roll 14 of the second forming wire 12 is shown on the wire loop side, through which breast roll the second forming wire 12 is guided into the dewatering area, and a suction roll 16, which guides the second forming wire 12 after the formation area into a second wire loop and from which, correspondingly, the formed web W is guided further to further treatment. In the manner shown by FIG. 1, suction roll 16 is provided with internal axial bevels 17, which limit a suction zone 18 or other such suction area in between them. The breast rolls 13, 14 are arranged in such a way that the forming wires 11, 12 traveling through them to the dewatering area form in between them a wedge-shaped formation gap G, into which headbox 1 feeds stock as a lip jet 2.

In former 10 there are two successive dewatering zones Z1, Z2, of which the lip jet 2 of headbox 1 is brought to the area of the first dewatering zone Z1. The first dewatering zone Z1 includes a forming shoe 3, wherein a surface touching the second forming wire 12 is of a curved shape, so that it will not cause any pulsating dewatering in the web W traveling between forming wires 11, 12. The forming shoe 3 and the first dewatering zone Z1 are examined more closely in connection with FIGS. 2, 3 and 3A. The first dewatering zone Z1 is followed by the second dewatering zone Z2, where pulsating dewatering is caused in the web W traveling between the forming wires. Pulsating dewatering is brought about in such a way that fixed dewatering blades 21 are arranged on the side of the first forming wire 11 inside the first wire loop and supported against the first forming wire 11, which dewatering blades are located in the cross-machine direction. The fixed dewatering blades 21 are arranged in such a way that gaps 22 in the cross-machine direction remain in between them. The fixed dewatering blades 21 are preferably arranged to form the bottom of a suction box connected with an under-pressure source 23. The under-pressure brought about by underpressure source 23 is applied to web W by way of the gaps 22 between the fixed dewatering blades 21.

Dewatering blades 24, which can be loaded in a controlled manner, are arranged against the second forming wire 12 on the side of the second forming wire 12, inside the second wire loop. The controlled dewatering blades 24 are in the cross-machine direction and they are arranged especially in such a way that the controlled dewatering blades 24 are located at the gaps 22 in between the fixed dewatering blades 21. With these dewatering blades (fixed/controlled) 21, 24 and with the combination of loading elements and the suction box 23 pulsating dewatering is brought about in web W.

Figure 2:
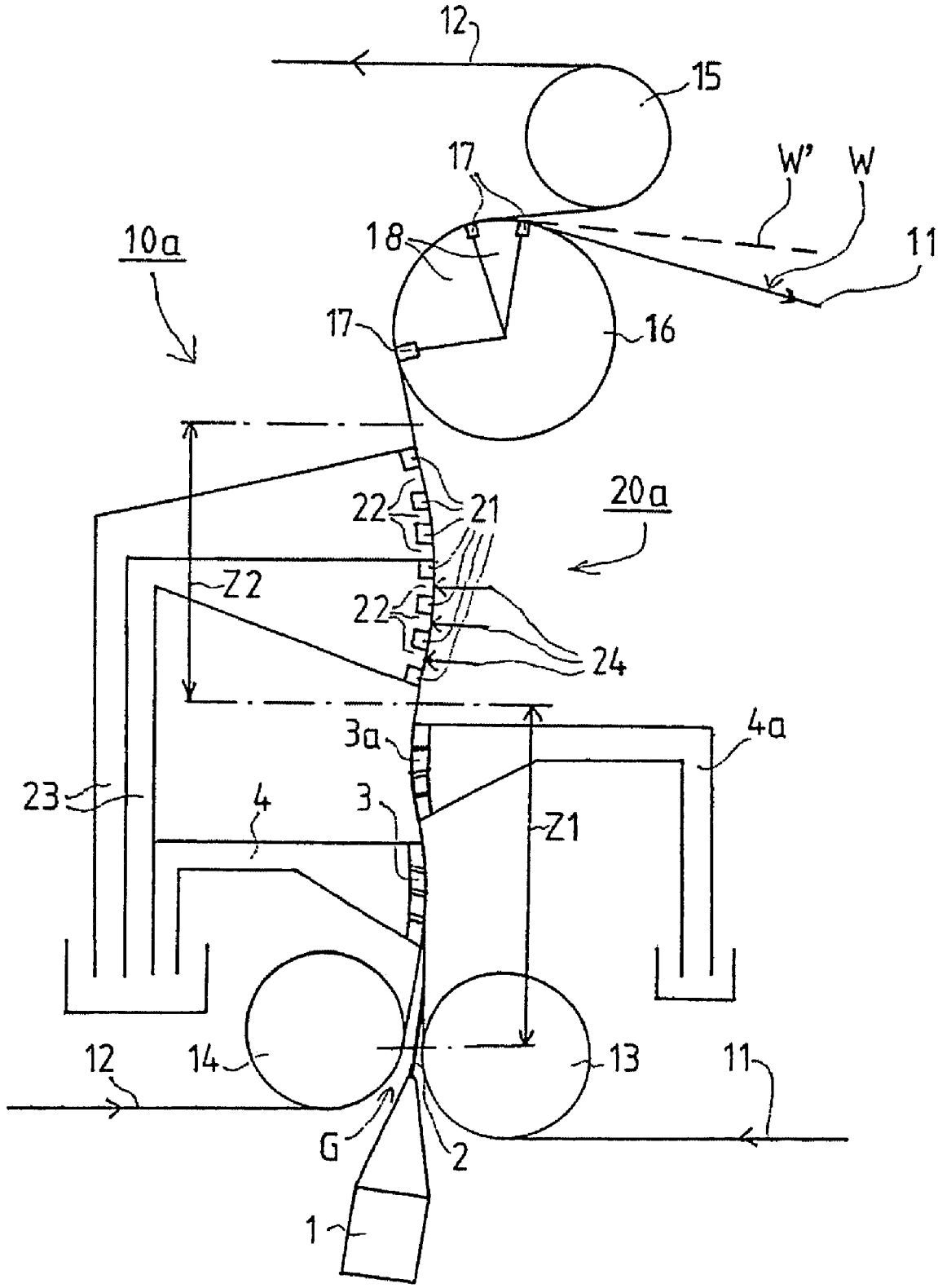
FIG. 2 is a view corresponding to FIG. 1 of a variation of the former according to FIG. 1.
Figure 3:
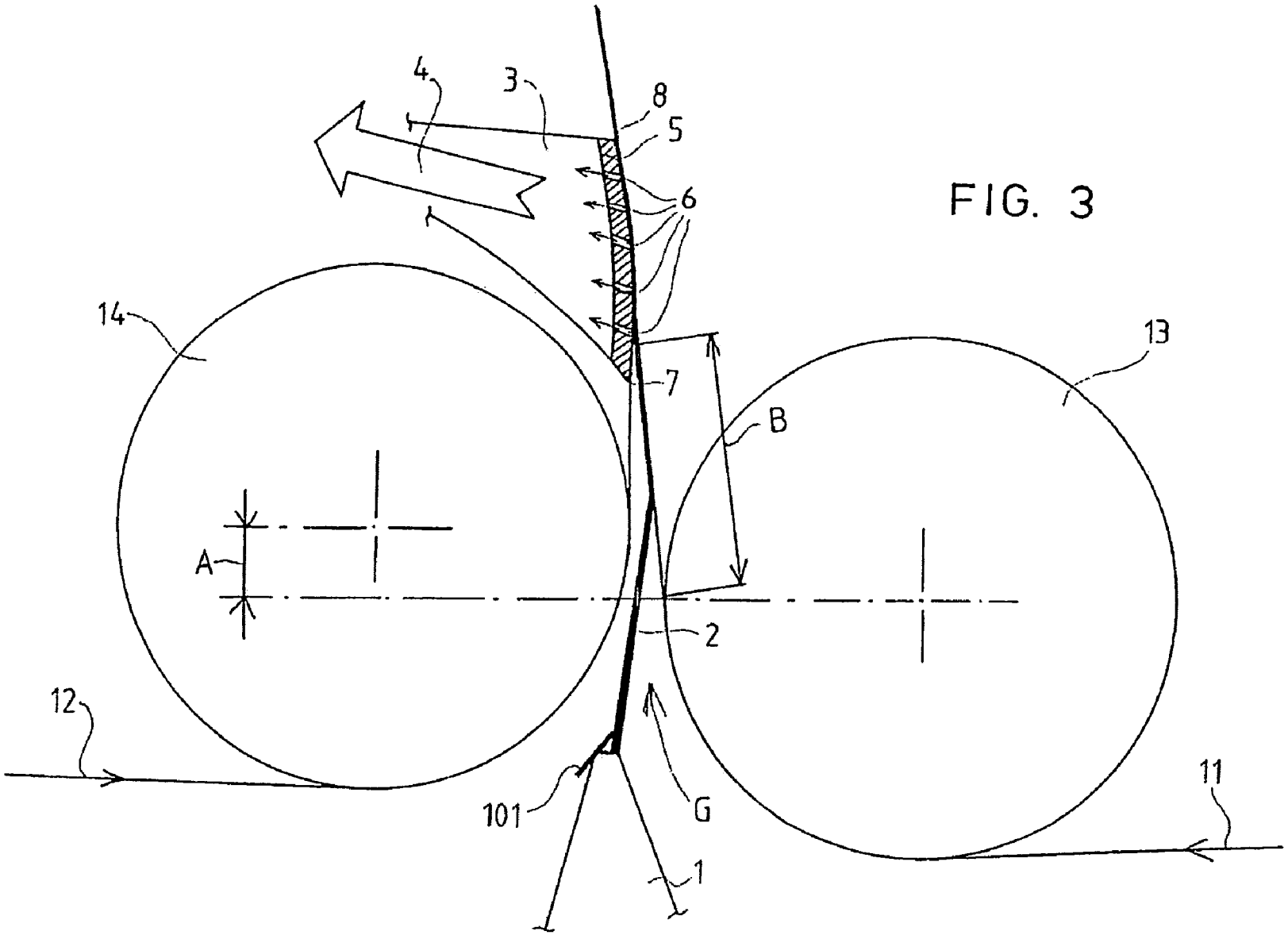
FIG. 3 is an enlarged detail of the starting end of the formers according to FIGS. 1 and 2, at the area hit by the headbox lip jet.

Thus, the first dewatering zone Z1 is formed by a curved forming shoe 3 located against the second forming wire 12, over which shoe the second forming wire 12 travels and in which forming shoe 3 there is a curved deck 5 provided with holes, openings, grooves, gaps or such 6 and forming the upper surface (FIGS. 2 and 3). Under forming shoe 3 underpressure is arranged as indicated by reference number 4 and illustrated by an arrow in FIG. 3 for removing water from the stock located in between forming wires 11, 12. The holes, openings, gaps, grooves or such 6 are arranged in the deck 5 of forming shoe 3 in such a way that the said deck 5 has a large open surface area, preferably 50-90 percent, and in such a way that due to their design and/or arrangement they do not cause any pressure pulses in web W. Pressure pulses may be caused in web W, if due to tension in forming wire 11, 12 an angle in the cross-machine direction is formed in between the forming wire and the openings in the deck. Pressure pulses will not be caused, if the open surface is formed by holes or by gaps or openings essentially in the longitudinal direction of the machine.

The holes 6 or such are preferably arranged in the manner shown by FIGS. 2 and 3 obliquely in relation to the deck 5 in such a way that water will be better guided into them. The angle of incidence of holes 6 or such in relation to the deck 5 is low. Deck 5 is given a curved shape, as pointed out above, and the radius of curvature R of deck 5 is within a range of 600-4000 mm, preferably within a range of 800-3000 mm. The overlap angle of wire 12 in the area of deck 5 is between 3 and 45 degrees, preferably between 5 and 30 degrees.

FIG. 2 shows a variation of the former according to FIG. 1, and the former is a blade type gap former in this embodiment too. The former is indicated generally by reference mark 10*a* and it includes two forming wires 11, 12, which are formed as endless wire loops (not shown) with the aid of hitch rolls and guiding rolls. Of the rolls FIG. 2 shows the first breast roll 13 on the wire loop side of the first forming wire 11, through which breast roll the first forming wire 11 is guided into the dewatering area, and a suction roll 16, which in this embodiment guides the first forming wire 11 after the formation area to form the first wire loop and from which, correspondingly, the formed web W is guided further to continued treatment either supported by the first forming wire 11 or as shown by dashed lines and reference mark W' in a corresponding way as in FIG. 1. Suction roll 16 is provided with internal axial seals 17 limiting in between them suction zones 18 or other such suction areas. Correspondingly, the second breast roll 14 is shown on the wire loop side of the second forming wire 12, through which breast roll the second forming wire 12 is guided into the dewatering area, and a guiding roll 15, which in this embodiment guides the second forming wire 12 after the formation area to form the second wire loop. The breast rolls 13, 14 are arranged in such a way that the forming wires 11, 12 passing through them into the dewatering area form in between them a wedge-shaped forming gap G, into which headbox 1 supplies the stock as a lip jet 2.

In former 10*a* there are two successive dewatering zones Z1, Z2, from which the lip jet 2 of headbox 1 is brought into the area of the first dewatering zone Z1. The first dewatering zone Z1 includes forming shoes 3, 3*a*, and wherein the surface contacting forming wire 11, 12 corresponding to a forming shoe is given a curved shape in such a way that it will not cause any pulsating dewatering in web W traveling in between forming wires 11, 12. Thus, in the embodiment shown in FIG. 2 there are two forming shoes 3, 3*a*, which are arranged one after the other on opposite sides of forming wires 11, 12 to remove water from the fibrous stock located in between forming wires 11, 12 through both forming wires 11, 12, that is, in both directions.

In the manner shown in FIG. 2, the first forming shoe 3 is used to remove water through the second forming wire 12 and, correspondingly, the second forming shoe 3*a* is used to remove water through the first forming wire 11. To boost dewatering, forming shoes 3, 3*a* are connected to an under-pressure source 4, 4*a*. Thus, in the presentation of FIG. 2 water is removed in the first dewatering zone Z1 from both surfaces of the web formed in between forming wires 11, 12 by non-pulsating forming shoe 3, 3*a*. This embodiment allows good symmetry and filler distribution in the web. Forming shoes 3 and 3*a* are similar as regards their function and structure. As regards the structure and function of forming shoe 3 and the forward end of the first dewatering zone Z1 reference is made to FIGS. 3, 4 and 4A.

The first dewatering zone Z1 is followed by a second dewatering zone Z2, wherein pulsating dewatering is caused to occur in the web W traveling in between the forming wires. In the embodiment shown in FIG. 2, pulsating dewatering is brought about in such a way that on the side of the second forming wire 12, inside the second wire loop, are arranged fixed dewatering blades 21, which are supported against the second forming wire 12 and are located in the cross-machine direction. The fixed dewatering blades 21 are arranged in such a way that gaps 22 in the cross-machine direction are formed between them. The fixed dewatering blades 21 are preferably arranged to form the bottom of a suction box connected to an underpressure source 23. The underpressure created by underpressure source 23 is applied to the web W by way of the gaps 22 between the fixed dewatering blades 21.

On the side of the first forming wire 11, inside the first wire loop, are arranged dewatering blades 24, which can be loaded in a controlled manner against the first forming wire 11. The controlled dewatering blades 24 are in the cross-machine direction and they are arranged especially in such a way that the controlled dewatering blades 24 are located at the gaps 22 located in between the fixed dewatering blades 21. With these dewatering blades (fixed/controlled) 21, 24 and with the combination of loading elements and suction box 23 pulsating dewatering is caused in web W. As is illustrated in FIG. 2, the controlled dewatering blades 24 are arranged at least at a part of the second dewatering zone Z2, preferably at the forward part of the second dewatering zone Z2. They may in fact also be arranged along the whole length of the second dewatering zone Z2, as is done, for example, in the presentation of FIG. 1. Correspondingly, the arrangement of FIG. 1 may also be similar to the one of FIG. 2 in this respect.

Figure 4:
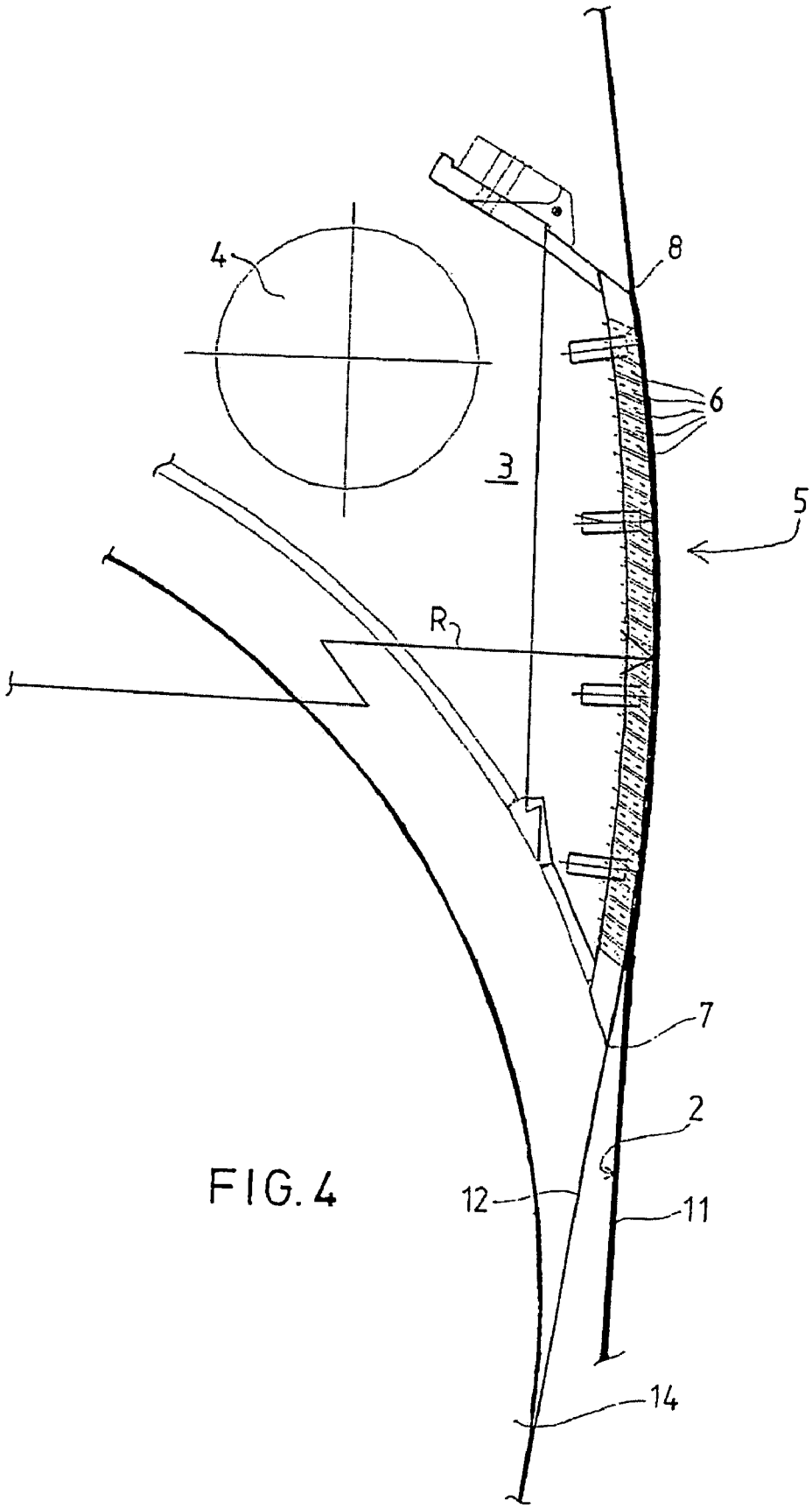
FIG. 4 is a cross-sectional view of an advantageous embodiment of the deck structure of the forming shoe shown in FIGS. 1, 2 and 3.
Figure 4A:
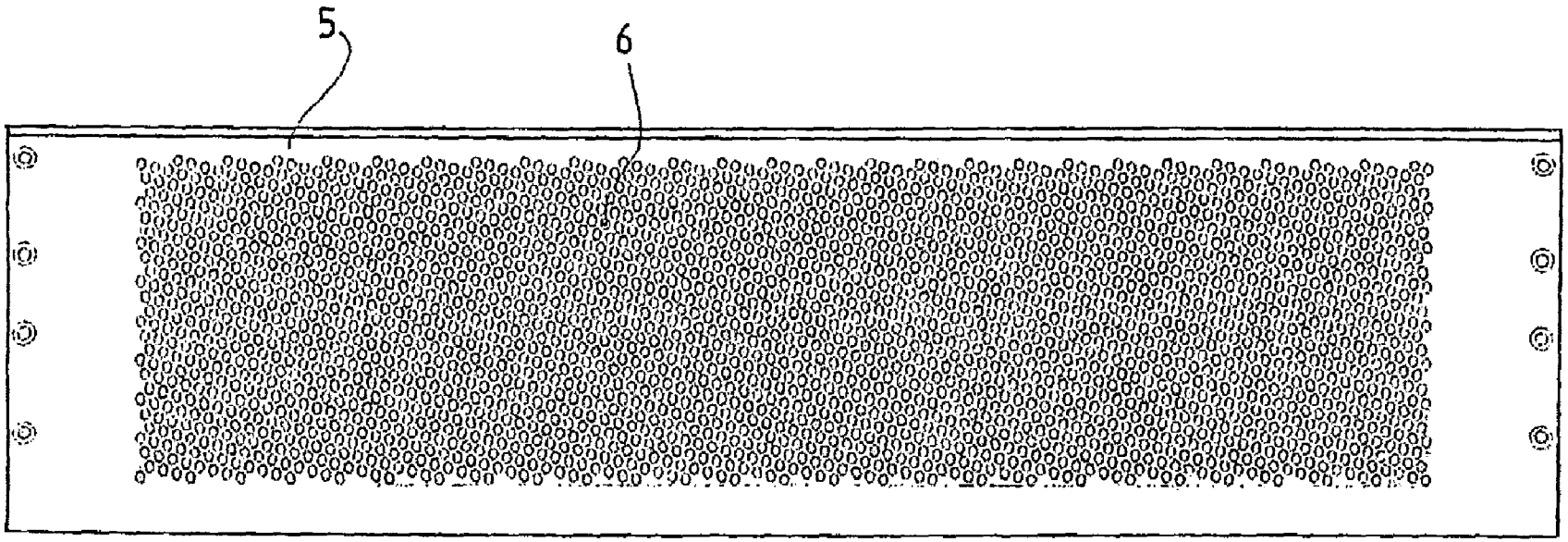
FIG. 4A shows the deck of the forming shoe looking in the surface direction.

Thus, in the presentation of FIG. 2, the first dewatering zone Z1 is formed by two curved and successively located forming shoes 3, 3*a*, which are located against forming wires 11, 12 and over which the forming wires 11, 12 are traveling. Each forming shoe 3, 3*a* has a curved deck 5 forming the upper surface and provided with holes, openings, grooves, gaps or such 6 (FIGS. 3 and 4). The forming shoes 3, 3*a* are connected to an underpressure source 4, 4*a* in such a way that under forming shoes 3, 3*a* an underpressure is arranged for removing water from the stock located in between forming wires 11, 12. The holes, openings, gaps, grooves or such 6 are arranged in such a way in the deck 5 of forming shoe 3, 3*a* that the said deck 5 has a large surface area, preferably 50-90 percent, and in such a way that due to their shape and/or arrangement they do not cause any pressure pulses in web W. Pressure pulses may be caused in web W, if due to tension in forming wire 11, 12 an angle is formed in between the forming wire and the openings in the deck in the cross-machine direction. Pressure pulses will not be caused, if the open surface is formed by holes or by gaps or openings located essentially in the longitudinal direction of the machine. The holes 6 or such are most advantageously arranged in the manner shown in FIGS. 3 and 4 obliquely in relation to deck 5, so that the water will be better guided into them. The angle of incidence of holes 6 or such in relation to deck 5 is low. Deck 5 is given a curved shape, as was mentioned earlier, and the radius of curvature R of deck 5 is in a range between 600 and 4000 mm, preferably between 800 and 3000 mm. The overlap angle of wire 11, 12 in the area of deck 5 is between 3 and 45 degrees, preferably between 5 and 30 degrees.

By looking more closely at FIG. 3 it is found that the lip jet 2 of headbox 1 is directed into forming gap G on the side of the forming wire opposite to forming shoe 3, that is, the first forming wire 11 in the figure. The lip jet 2 is thus directed against the first forming wire 11 into the unsupported area B of the said wire 11 before forming shoe 3. Hereby the stock supplied by headbox 1 and transported by the first forming wire 11 will not hit the leading edge or tip 7 of forming shoe 3, but it meets forming shoe 3 only after tip 7 in the area of deck 5. Thus, the leading edge 7 of forming shoe 3 will not remove any water at all, which is of essential significance for the operation. As lip jet 2 of headbox 1 meets forming wire 12 only in the area of the deck 5 of the forming shoe 3, this also leaves time to remove the air transported by the forming wire 12 and the lip jet 2 by the underpressure affecting through holes 6 in the deck 5 before the lip jet 2 meets the forming wire 12.

The free directing of the lip jet 2 in the desired manner into the unsupported area of the first forming wire 11 after the first breast roll 13 is made possible by the geometry presented in FIG. 3, to the effect that the breast rolls 13 and 14 are not in the same plane, but in the presentation shown in the figure the breast roll 14 (the second breast roll) of the wire loop (the second wire loop) on the side of the forming shoe 3 is in a higher location than the breast roll 13 (the first breast roll) of the opposite wire loop (the first wire loop). Thus, in relation to the stock feeding direction the breast roll 14 on the side of forming shoe 3 is located after the breast roll 13 located on the opposite side. This lateral shift is illustrated by reference mark A in FIG. 3. The dewatering event can be controlled and changed by using a replacing forming shoe 3 having a different curvature. Within the area of forming gap G the curvature control and dewatering control are essentially better than in earlier solutions. In the solution shown in FIG. 3, the profile bar of headbox 1 indicated by reference number 101 and forming shoe 3 are preferably on the same side of headbox 1 as lip jet 2. This allows as short a lip jet as possible from headbox 1 to the wire section.

It is an advantage of a blade type gap former 10, 10*a* of this type that it can be used to make symmetric paper, because underpressure levels can be used to control the dewatering distribution removed by the dewatering zones Z1, Z2 on the side of the different wire loops. In addition, this type of blade type gap former 10, 10*a* can be used to guide the web W with a sufficiently low dry matter content to the loading element-suction box combination 21, 23, 24, whereby pulsating dewatering can be used to achieve as good a formation of paper/board web W as possible. If the dry matter content of the web W is too high, the formation of paper can no longer be improved with the loading element-suction box combination 21, 23, 24. Retention also remains good, because the non-pulsating forming shoe 3 removes water from web W depending on the ratio between the tension of wire 11, 12 and the curvature of the deck 5 of the forming shoe 3 (dewatering pressure=tension of wire 11, 12/radius of curvature of deck 5 of forming shoe 3, that is, P=T/R) and assisted by the underpressure of forming shoe 3. The underpressure level is preferably 1-25 kPa.

Blade type gap formers have been known for quite a long time. In these known formers, the first dewatering element has been the forming shoe, which has been used to cause pulsating dewatering in the web. With such an arrangement formation has been good, but retention poor, and the paper has been one-sided, that is, asymmetric. US patent application publication No. 2001/0025697 (U.S. Pat. No. 6,372,091) presents as the first dewatering element a non-pulsating forming shoe, whereby it can be assumed that with the solution according to this publication both retention and paper symmetry have been improved, but good formation of the paper is lost at the same time, because after this non-pulsating forming shoe a dewatering zone is arranged, which does not cause pressure pulses of sufficient strength in the web.

Dewatering systems including two or more dewatering zones are known as such. It is also known to use a combination of non-pulsating dewatering zone together with a pulsating dewatering zone in blade type gap formers, wherein the stock is guided from the headbox into a gap between two forming wires, whereby the first non-pulsating dewatering zone includes a forming roll (an open suction roll), which is followed by the pulsating dewatering zone containing a combination of loading element and suction box. With such an arrangement good retention and symmetric paper have been achieved, but poorer formation than with the traditional blade type gap formers. It was found that the reason for this was the fact that the forming roll's rotation causes an underpressure peak in the web after the forming roll, which peak damages the already formed web. It is an advantage of the present invention in this regard that the fixed non-pulsating forming shoe does not cause any underpressure peak after the forming shoe, with the result that the web can be brought into the loading element-suction box combination with a low dry matter content, whereby an excellent formation is achieved in the web with this combination of loading element and suction box. This means that the present invention combines the good points and advantages of the blade type gap formers and the roll and blade gap formers.

Figure 5:
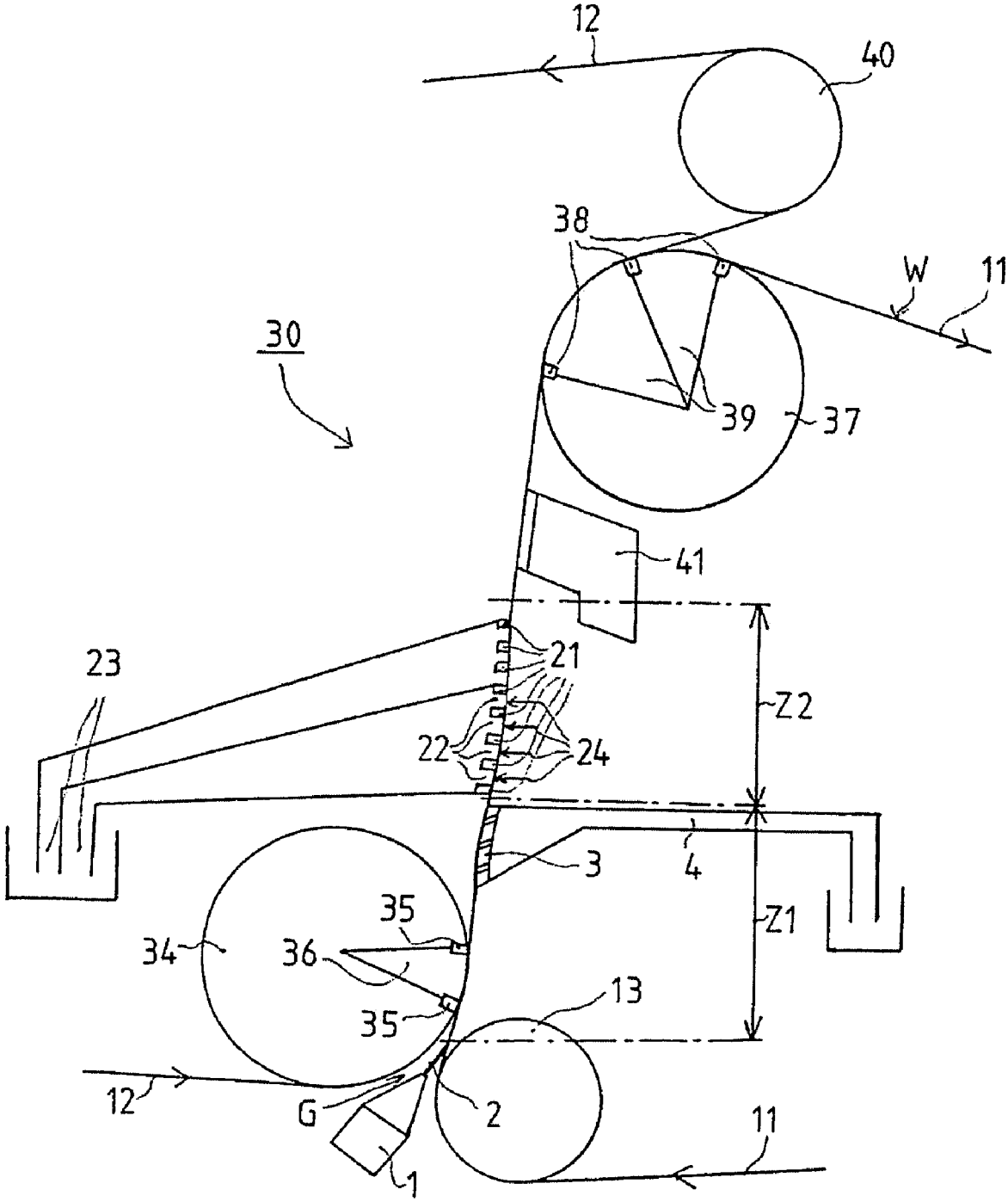
FIG. 5 is a schematic lateral view of an advantageous embodiment of a different type of former according to the invention.
Figure 6:
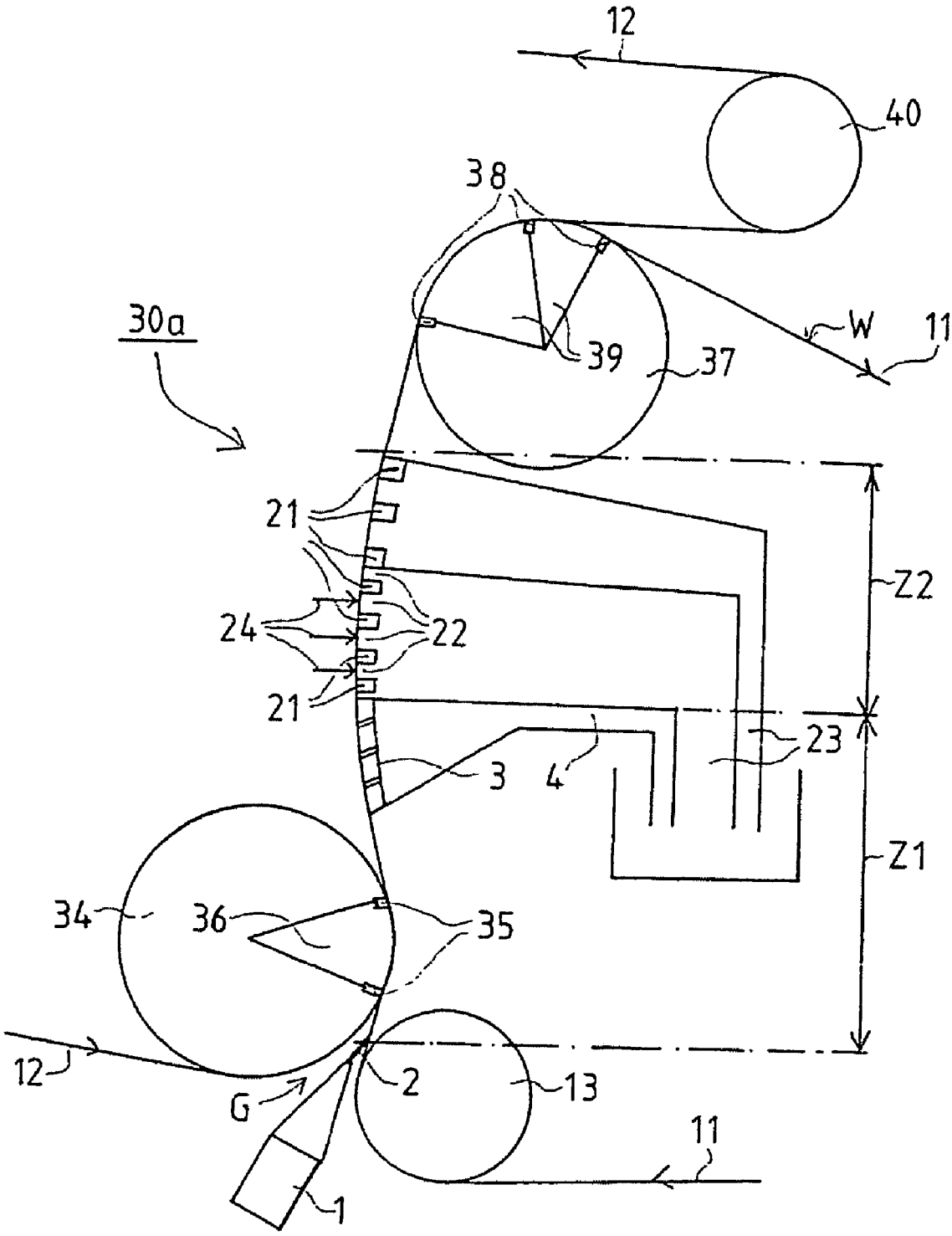
FIG. 6 is a view corresponding to FIG. 5 of a variation of the former according to FIG. 5.

FIGS. 5 and 6 show some more alternative embodiments of the invention. FIGS. 5 and 6 show a roll and blade gap former indicated generally by reference number 30 in FIG. 5 and by reference mark 30*a* in FIG. 6. Former 30, 30*a* includes two forming wires 11, 12, which are formed into endless wire loops (not shown) using hitch rolls and guiding rolls. Of the rolls FIGS. 5 and 6 show the first breast roll 13 on the side of the wire loop of the first forming wire 11, through which breast roll the first forming wire 11 is guided into the dewatering area, and the second forming roll 37 or other such suction roll, which guides the first forming wire 11 after the formation area to form the first wire loop. The second forming roll 37 is equipped with suction zones 39 limited by the roll's internal crosswise seals 38, which suction zones are used to make sure that the web W formed after the mentioned suction zones 39 will follow the first forming wire 11, on which web W is taken to a pick-up roll (not shown), by which web W is transferred on to a pick-up fabric (not shown) and further to continued treatment, such as into a press section (not shown).

Correspondingly, the forming roll 34 (the first forming roll) is shown on the wire loop side of the second forming wire 12, through which forming roll the second forming wire 12 is guided into a dewatering area, and a guiding roll 40 guiding the second forming wire 12 after the formation area to form the second wire loop. Breast roll 13 and forming roll 34 are arranged in such a way that the forming wires 11, 12 traveling through them into the dewatering area will form in between them a wedge-shaped forming gap G, into which headbox 1 supplies the stock as a lip jet 2. Forming roll 34 is a suction roll provided with an open, for example, perforated surface and containing a suction zone 36 limited by the roll's internal axial, that is, crosswise seals 35.

Former 30, 30*a* has two successive dewatering zones Z1, Z2 and the lip jet 2 of headbox 1 is brought into the area of the first dewatering zone Z1. The first dewatering zone Z1 is a non-pulsating dewatering zone and it is in fact divided into two parts in such a way that the first part of the non-pulsating dewatering zone includes the forming roll 34 located on the side of the second forming wire 12, and correspondingly, the second part includes a forming shoe 3, which is located after forming roll 34 and is arranged on the side of the first forming wire 11, in which forming shoe the surface contacting the first forming wire 11 is given a curved shape, so that it will not cause any pulsating dewatering in web W traveling in between forming wires 11, 12. The forming shoe 3 used in these embodiments is connected to an underpressure source 4 and it is of a similar kind to that already described in connection with the former 10 of FIG. 1 and whose structure and function was described in greater detail with the aid of FIGS. 3, 4 and 4A. In this regard reference is made to the earlier specification.

In these embodiments, too, the first dewatering zone Z1 is followed by a second dewatering zone Z2, wherein pulsating dewatering is brought about in web W traveling in between the forming wires. The pulsating dewatering is brought about in the roll and blade gap former 30 according to FIG. 5 in such a way that on the side of the second forming wire 12, inside the second wire loop, fixed dewatering blades 21 are arranged, which are supported against the second forming wire 12 and are located in the cross-machine direction. The fixed dewatering blades 21 are arranged in such a way that gaps 22 in the cross-machine direction are formed between them. The fixed dewatering blades 21 are preferably arranged to form the bottom of a suction box connected to underpressure source 23. The underpressure generated by underpressure source 23 is applied to web W through the gaps 22 between the fixed dewatering blades 21. The roll and blade gap former 30*a* of FIG. 6 has corresponding fixed dewatering blades 21 arranged on the side of the first forming wire 11, inside the first wire loop, to support against the first forming wire 11. In other respects the structure is similar to the one presented in connection with FIG. 5 with its underpressure source 23, gaps 22 between the fixed dewatering blades 21, etc.

In the embodiment shown in FIG. 5, dewatering blades 24 are arranged on the side of the first forming wire 11, inside the first wire loop, which dewatering blades can be loaded in a controlled manner against the first forming wire 11. In the solution shown in FIG. 6, the corresponding controlled dewatering blades 24 are arranged on the side of the second forming wire 12, inside the second wire loop. The controlled dewatering blades 24 are in the cross-machine direction and they are arranged especially in such a way that the controlled dewatering blades 24 are located at the gaps 22 in between the fixed dewatering blades 21. With these dewatering blades (fixed/controlled) 21, 24 and with the loading element-suction box 23 combination pulsating dewatering is caused in web W. In the arrangements according to the invention shown in FIGS. 5 and 6 a non-pulsating forming shoe 3 is thus located on the opposite side of the web in relation to forming roll 34 immediately after forming roll 34. This results in a new control possibility, with which it is possible to control the characteristics of the web's bottom surface on the opposite side in relation to forming roll 34. It has not been possible earlier to do much controlling of dewatering in roll and blade gap formers 30 on this side, which means that a significant advantage is achieved with the invention compared with the state of the art. In addition, with the solutions according to FIGS. 5 and 6 non-pulsating dewatering at underpressure is achieved on both surfaces of the web, whereupon both web surfaces are guided into the area of pulsating dewatering. The structure of the non-pulsating forming shoe 3 allows the use of a high underpressure level, at its maximum an underpressure level of up to 25 kPa. This again allows a better dewatering capacity as well as better formation and better control of the filler distribution.

Figure 7:
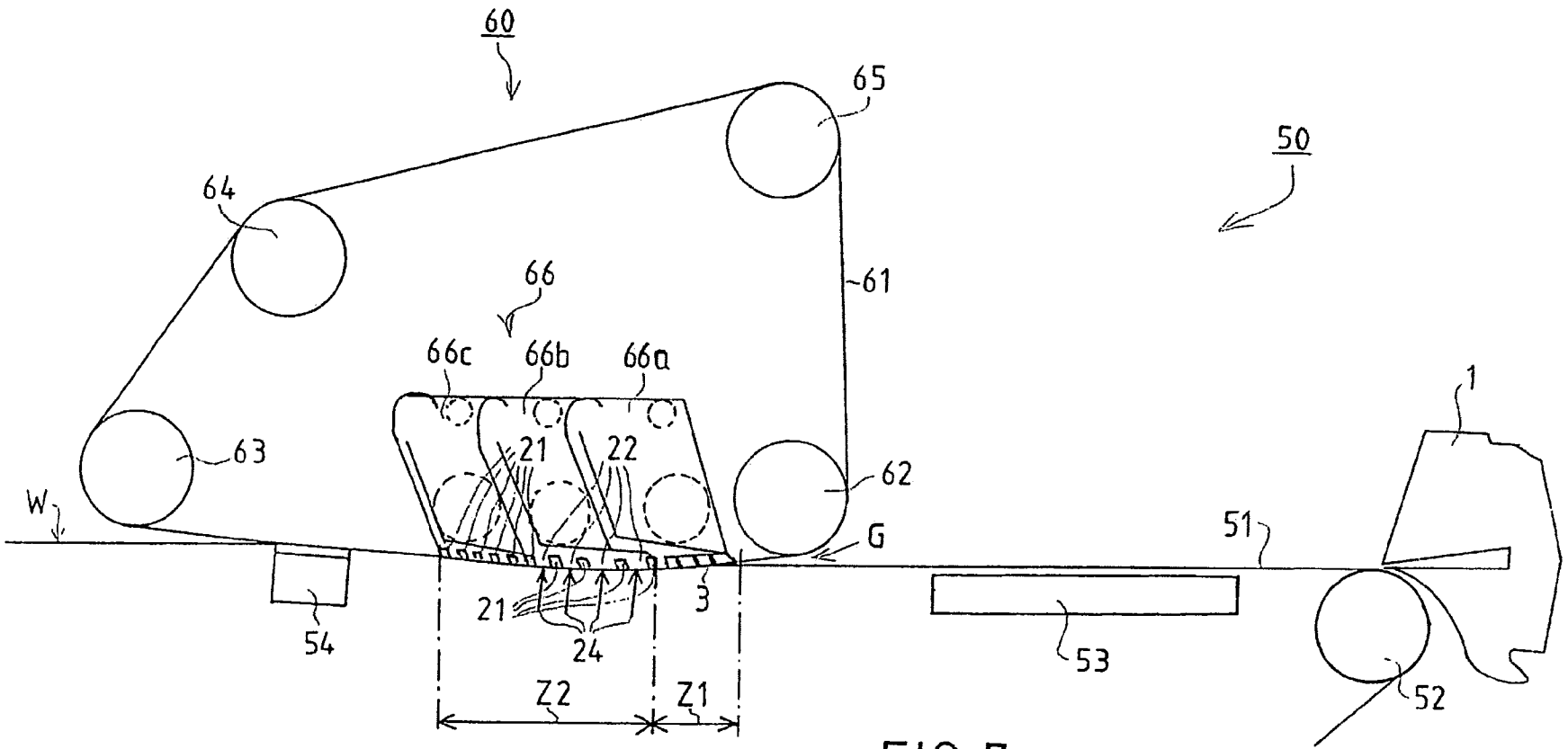
FIG. 7 is a schematic lateral view of an application in a hybrid former of the forming shoe forming an essential part of the invention.

FIG. 7 is a schematic view of an application of the invention in connection with a hybrid former. Reference number 50 indicates the hybrid former as a whole in FIG. 7. In the known manner, hybrid former 50 includes a fourdrinier wire section including a fourdrinier wire 51 and dewatering equipment arranged under the fourdrinier wire. Headbox 1 feeds stock on to fourdrinier wire 51 at the forward end of the fourdrinier wire section on to breast roll 52 or immediately after it. In fourdrinier wire section 51 dewatering takes place in one direction only, that is, downwards with the aid of the dewatering equipment 53 arranged. The dewatering equipment 53 of the fourdrinier wire section are shown quite schematically in FIG. 5 and they may include, for example, dewatering blades either with or without suction, various suction boxes, forming shoes or other such. They are not essential from the viewpoint of the invention and for this reason they are not described in greater detail in this connection.

A former unit 60 is installed on top of fourdrinier wire 51 in such a way that the concerned former unit 60 together with fourdrinier wire 51 form a twin-wire part in former 50. Former unit 60 includes a top wire 61, which is made to form an endless wire loop with the aid of hitch rolls and guiding rolls 62, 63, 64, 65 and the first roll 62 of which is fitted above fourdrinier wire 51 in such a way that at the beginning of the twin-wire part a wedge-like gap G is formed, into which the stock supplied on to fourdrinier wire 51 is guided. Before the stock ends up in the gap water has already been removed from it with the aid of the dewatering equipment 53 of fourdrinier wire 51. Inside top wire loop 61 a suction box 66 is mounted, which in the example shown in FIG. 7 is divided into three successive suction chambers 66*a*, 66*b*, 66*c*, in which underpressure levels of different magnitude may be used in the desired manner. After suction box 66 an underpressurized transfer suction box 54 is arranged under fourdrinier wire 51 to make sure that the formed web W will after the twin-wire part follow fourdrinier wire 51, from which it will later be picked up at the pick-up point (not shown) for further treatment.

According to the invention, the lower surface of the first chamber 66*a* of suction box 66, which lower surface is contacting top wire 61, is formed by a forming shoe 3 of a kind similar to that described earlier in connection with the embodiments according to FIGS. 1, 2, 5 and 6. Thus, forming shoe 3 has such a structure as is described in greater detail with the aid of FIGS. 3, 4 and 4A. Thus, in this regard reference is made to the earlier description. The bottom of the second and third suction chambers 66*b* and 66*a* of the suction box is formed with the aid of fixed dewatering blades 21 in such a way that in between these fixed dewatering blades 21 there are gaps 22, through which underpressures affecting in suction chambers 66*b*, 66*c* will affect the partly already formed web located in between top wire 61 and fourdrinier wire 51 in order to remove water from it. Furthermore, in the example shown in FIG. 7, at the second suction chamber 66*b* under fourdrinier wire 51 controlled dewatering blades 24 are arranged, which are loaded against fourdrinier wire 51 and which furthermore according to the presentation in FIG. 7 are located at the gaps 22 located in between the fixed dewatering blades 21. With this solution pulsating dewatering is brought about at the concerned blades, as was already described in connection with the earlier embodiments of the invention.

Thus, at the first chamber 66*a* of suction box 66 a forming shoe 3 is mounted in the manner described above, which forming shoe does not cause any pulsating dewatering in the web. Forming shoe 3 is further arranged in such a way that the fibrous stock arriving on fourdrinier wire 51 into gap G will not hit the leading edge of forming shoe 3, but it is guided after the leading edge into the area of the deck of forming shoe 3. Thus, the leading edge of forming shoe 3 will not remove water from the fibrous stock, exactly in the same manner as was described, for example, in connection with FIG. 1. Thus, in the area of the suction box there are two successive dewatering zones, that is, the first dewatering zone Z1 in the area of forming shoe 3, which is used to cause non-pulsating dewatering, and the second dewatering zone Z2, which is located in the area of the fixed and controlled dewatering blades 21, 24 and which is used to cause pulsating dewatering. Thus, the non-pulsating dewatering and the pulsating dewatering take place in the same manner and in the same order one after the other as was described, for example, in connection with FIG. 1, even though forming shoe 3 in the example shown in FIG. 7 is located on the side of the fixed dewatering blades 21 in relation to the forming wires 51, 61, differently from the example shown in FIG. 1.

Thus, the advantages of the solution according to FIG. 7 in comparison with the state of the art are in the same direction and mainly similar to those in the example shown in FIG. 1. The high dewatering capacity made possible by forming shoe 3 makes it possible that the consistency entering the twin-wire zone with each paper grade can be optimized according to the paper grade to be made. Hereby the fourdrinier wire stretch can also be shortened and in addition the web caliper may also vary within a larger range than at present at the entry to the twin-wire zone.

As was already noted above, the new former according to the invention is a combination of two elements both as regards its structure and in process technical terms, in such a way that all advantages of roll and blade gap formers, blade type gap formers and hybrid formers can be achieved without any of their associated drawbacks. The first element is a new type of fixed forming shoe 3 having a curved deck 5, in which forming shoe it is possible to use underpressure 4 to control the dewatering and to make it more efficient. This forming shoe may be used either below or above web W. It is constructed in such a way that dewatering may take place freely and simultaneously through both forming wires traveling over the curved deck 5 of forming shoe 3. It is an important characteristic feature of the forming shoe 3 according to the invention that its deck 5 is constructed to give an essentially constant dewatering pressure in accordance with equation P=T/R, wherein P=pressure of the liquid located in between the forming wires traveling over the forming shoe, T=tension of the outer fabric and R=curvature of the fixed forming shoe. The purpose is that the forming shoe does not cause any pulsating dewatering even when dewatering is boosted by underpressure. Such an idea is possible, that the forming shoe according to the invention is the arch of a "fixed roll" provided with an open surface. The deck has a large open surface area and through openings it is connected to an underpressure chamber located inside the forming shoe. The openings in the deck of the forming shoe are formed in such a way that pulsating dewatering is avoided, which would result if the openings were directed essentially in the crosswise direction. In order to achieve this essentially constant pressure, these openings are either round holes, elliptic holes, gaps arranged essentially in the machine direction, wavelike gaps, protruding contact surfaces to support the fabric above the shoe deck, etc.

In the present invention, the second dewatering element is a pulsating dewatering zone known in the state of the art, wherein there are crosswise fixed dewatering blades provided with gaps, which bring about dewatering that is made even more efficient by using controlled dewatering blades on the opposite side of the forming wires in order to increase the pulsating effect even further.

There are several possible different ways of combining these two different types of dewatering elements in order to achieve the advantages of formers of a known type without their associated drawbacks, such as is shown in FIGS. 1-7. The reasons for the synergy provided by this combination of dewatering elements are the following:

Dewatering first takes place essentially at a constant pressure in the non-pulsating zone as two-sided dewatering (as happens also with a roll), owing to which the structure in the Z direction is as symmetric as with a roll.

The effect of the lip jet of the headbox is also analogous as regards what happens in connection with a roll, that is, the lip jet is directed over the surface having a slight curvature, which may be associated with underpressure-assisted dewatering into the convex deck of the forming shoe.

The resulting angle of fabrics or forming wires reducing in a wedge-like fashion makes the lip jet insensitive to numerous faults and trouble.

On the output side of the non-pulsating zone having a constant pressure no under-pressure peaks will occur, because the structure forming this zone is fixed. In this way the web-damaging effect is avoided, which will occur when the originally constant-pressure or non-pulsating zone is formed by a roll. The constant-pressure zone does not limit the former's dewatering capacity, but the relatively wet web may be transferred into the pulsating dewatering zone in order to achieve the full advantage from the ability of this second dewatering zone to improve formation.

The capital and maintenance costs of the fixed structure of the non-pulsating dewatering zone according to the invention are lower than the corresponding costs of a roll and standby roll.

It is possible to vary the radius of the non-pulsating dewatering zone according to the invention over a larger area than is practical when using a roll. Compared with a roll, it is a further advantage of the fixed dewatering zone that the forming shoe radius can be modified (for example, in such a way that it is longer at the input end, but it becomes progressively shorter as a spiral curve towards the exit end). In such a case the dewatering pressure is no longer constant over the forming shoe, but it still remains non-pulsating and it is therefore still advantageous compared with state-of-the-art forming shoes. The possibility to alter the radius in both these ways means that the non-pulsating dewatering can be designed at each time to be suitable for each application better than it is possible to do with a roll.

The combination of the fixed non-pulsating dewatering zone and the state-of-the-art pulsating zone allows easier control of the dewatering degree between the non-pulsating and pulsating dewatering zones, whereby the dewatering zone can be controlled better and more easily than in the state-of-the-art formers. Thus, the balance between formation and retention can be better controlled.

It should be understood that the invention is not strictly limited to any one special structure and arrangement described and specified herein, but it can be modified within the scope of the appended claims.

The invention claimed is:

1. A method of forming a web in a twin-wire formation section of a paper or board machine, comprising the steps of:

supplying a lip jet of fibrous stock from a headbox to a first forming wire forming a first wire loop so that the fibrous stock travels only on the first forming wire;

moving a second forming wire forming a second wire loop against a fixed forming shoe, the forming shoe having a leading edge and a deck having a curved surface, the second forming wire being supported by and moves against an area defined by the curved surface of the forming shoe deck;

bringing the fibrous stock on the first forming wire into engagement with the second forming wire on the curved surface of the forming shoe deck at a position after the forming shoe leading edge, the first forming wire being unsupported in the area defined by the curved surface of the shoe;

guiding the fibrous stock between the first and second forming wires so that dewatering of the fibrous stock begins after the shoe leading edge, wherein essentially non-pulsating dewatering takes place in the first dewatering zone;

removing water from the fibrous stock in a successive second dewatering zone through which the first forming wire, the second forming wire and the fibrous stock therebetween travel, the second dewatering zone formed by fixed dewatering blades which extend in a cross-machine direction, and engage one of the forming wires, the fixed dewatering blades defining gaps therebetween; and supporting against the other of the forming wires movable dewatering blades, which are loaded in a controlled fashion opposite the gaps and between the fixed dewatering blades against the fibrous stock between the forming wires so that the second dewatering zone causes pulsating dewatering in the fibrous stock.

2. The method of claim 1, further comprising the step of applying underpressure to the fibrous stock through the deck of the fixed forming shoe.

3. A twin-wire forming section of a paper or board machine, comprising:

a headbox;

a first forming wire forming a first wire loop with the aid of first guiding rolls and a first breast roll;

a second forming wire forming a second wire loop with the aid of second guiding rolls and a second breast roll, wherein the second breast roll is spaced further from the headbox than the first breast roll is spaced from the headbox;

the first forming wire and the second forming wire forming a twin-wire dewatering area therebetween, said twin-wire dewatering area being located after the first forming wire passes over the first breast roll, and the second forming wire passes over the second breast roll, said twin-wire dewatering area having a beginning, the dewatering area arranged in to at least a first dewatering zone, and a second successive dewatering zone;

wherein the headbox is arranged to form a lip jet directed to engage only the first forming wire at a location spaced from the first breast roll and before the twin-wire dewatering area, such that a lip jet will travel only with the first forming wire until the beginning of the twin-wire dewatering area;

a fixed forming shoe in the first dewatering zone having a curved surface deck, and a leading edge, the curved surface deck in supporting engagement with the second forming wire with the leading edge extending towards the second breast roll so that the leading edge is positioned before the beginning of the dewatering area;

wherein the first forming wire is unsupported over the fixed forming shoe;

wherein the second and successive dewatering zone is formed by a plurality of fixed dewatering blades engaging one of the forming wires in the cross-machine direction and supported against a fibrous stock between the first forming wire and the second wire, wherein the fixed dewatering blades define gaps therebetween;

a plurality of movable dewatering blades mounted for a loading motion in a controlled manner against the fibrous stock located between the first forming wire and the second wire, the movable dewatering blades being opposite the gaps and engaging the other forming wire at the gaps in between the fixed dewatering blades, so causing pulsating dewatering in the fibrous stock in the second dewatering zone; and wherein the fixed forming shoe is provided with an essentially open surface and a source of underpressure arranged under the forming shoe so as to cause essentially non-pulsating dewatering in the fibrous stock traveling in between the forming wires.

4. The apparatus of claim 3, wherein the open surface area of the deck of the fixed forming shoe is at least 50 percent of the total surface area of the shoe.

5. The apparatus of claim 3, wherein the open surface area of the deck of the fixed forming shoe is formed of holes extending through the deck.

6. The apparatus of claim 5, wherein the holes extending through the deck and forming the open surface area of the deck of the fixed forming shoe are arranged at an angle in relation to the top surface of the deck and against a first direction and wherein the first wire and the second wire are mounted to travel in the first direction.

7. The apparatus of claim 3, wherein the radius of curvature of the deck of the fixed forming shoe is between 600 mm and 4000 mm.

8. The apparatus of claim 3, wherein the headbox has a profile bar and wherein the profile bar and the forming shoe are on the same side of the headbox.

9. A hybrid forming section of a paper or board machine, comprising:

a fourdrinier first forming wire forming a first loop, and an upper horizontal surface;

a headbox arranged to form a fibrous stock on the upper horizontal surface;

dewatering equipment arranged under the upper horizontal surface so that a fibrous stock on the upper horizontal surface is dewatered only in a downward direction;

a former unit fitted on top of the fourdrinier first forming wire and spaced in a downstream direction from the dewatering equipment, the former unit having a second forming wire forming a second wire loop;

the fourdrinier first forming wire and the second forming wire forming a twin-wire dewatering area therebetween, said area having a beginning; in such a way that at the beginning of the twin-wire dewatering area a wedge-like gap is formed, into which a fibrous stock on the fourdrinier first forming wire is arranged to travel;

wherein the twin-wire dewatering area is arranged into at least a first dewatering zone and a second successive dewatering zone;

wherein at least a part of the first dewatering zone is formed with at least one fixed forming shoe having a curved surface deck, and a leading edge, the curved surface deck in engagement with the second forming wire, and wherein the second forming wire is arranged not to contact a fibrous stock on the first forming wire until after the leading edge of the fixed forming shoe;

wherein the fourdrinier first forming wire is unsupported at the fixed forming shoe;

wherein the second successive dewatering zone is formed by a plurality of fixed dewatering blades engaging the second forming wire in the cross-machine direction and supported against a fibrous stock between the second forming wire and the fourdrinier first forming wire;

wherein the fixed dewatering blades define gaps therebetween;

a plurality of movable dewatering blades mounted for a loading motion in a controlled manner against the fourdrinier first forming wire and a fibrous stock located between the fourdrinier first forming wire and the second forming wire, the movable dewatering blades opposite the gaps and engaging the fourdrinier first forming wire at the gaps in between the fixed dewatering blades, so causing pulsating dewatering in a fibrous stock in the second dewatering zone;

wherein the fourdrinier first forming wire and the second forming wire are guided from the beginning of the twin-wire forming section into the area of the fixed forming shoe of the first dewatering zone, and wherein the fixed forming shoe is provided with an essentially open surface connected to a source of underpressure arranged over the forming shoe so as to cause essentially non-pulsating dewatering in a fibrous stock traveling in between the fourdrinier first forming wire and the second forming wire; and wherein the non-pulsating dewatering in the first zone is applied to a fibrous stock in an area after the leading edge of the forming shoe.

10. A method of forming a web in a hybrid formation section of a paper or board machine, comprising the steps of:

supplying and guiding a fibrous stock from a headbox onto an upper horizontal surface of a fourdrinier first forming wire forming a fourdrinier former, the fourdrinier first forming wire forming a first wire loop;

dewatering the fibrous stock on the upper horizontal surface of the fourdrinier first forming wire from one direction only with dewatering equipment below the upper horizontal surface of the fourdrinier first forming wire;

following dewatering in one direction only on the fourdrinier first forming wire, passing the dewatered fibrous stock into a gap formed between the fourdrinier first forming wire and a second forming wire positioned on top of the fourdrinier first forming wire, the second forming wire defining a second wire loop which defines a twin-wire former with the fourdrinier first forming wire;

non-pulsating dewatering the fibrous stock in a first dewatering zone following the gap of the twin-wire former with at least one fixed non-pulsating forming shoe having a curved surface deck and a leading edge, the curved surface deck in engagement with the second forming wire;

drawing an underpressure on an essentially open surface of the forming shoe from above the forming shoe, and guiding the second forming wire so the second forming wire does not contact the fibrous stock on the first forming wire until after the leading edge of the fixed forming shoe, and wherein the second forming wire is supported by and moves against an area defined by the curved surface of the shoe while the fourdrinier first forming wire positioned opposite the second forming wire is unsupported in the area defined by the curved surface of the shoe;

removing water from the fibrous stock in a successive second pulsating dewatering zone through which the fourdrinier first forming wire, the second forming wire and the fibrous stock therebetween travel, the second dewatering zone formed by fixed dewatering blades extending in a cross-machine direction, and engaging the second forming wire, the fixed dewatering blades defining gaps therebetween; and supporting against the fourdrinier forming wire movable dewatering blades, and loading in a controlled fashion the movable dewatering blades opposite the gaps and between the fixed dewatering blades against the fibrous stock between the forming wires so that the second dewatering zone causes pulsating dewatering in the fibrous stock.

* * * * *